US006755146B1

(12) United States Patent
Garelick et al.

(10) Patent No.: US 6,755,146 B1
(45) Date of Patent: Jun. 29, 2004

(54) COMPACTABLE BOAT LADDER

(75) Inventors: Richard J. Garelick, Minneapolis, MN (US); Paul A. Pilosi, Minnetonka, MN (US); Charles J. Hauck, Inver Grove Heights, MN (US)

(73) Assignee: Garelick Mfg. Co., St. Paul Park, MN (US)

( * ) Notice: Subject to any disclaimer, the term of this patent is extended or adjusted under 35 U.S.C. 154(b) by 0 days.

(21) Appl. No.: 10/438,394

(22) Filed: May 16, 2003

Related U.S. Application Data

(60) Provisional application No. 60/390,545, filed on Jun. 24, 2002.

(51) Int. Cl.[7] ..... B63B 17/00

(52) U.S. Cl. ..... 114/362; 182/90; 182/95

(58) Field of Search ..... 114/343, 362; 182/82, 89, 90, 91, 92, 93, 95, 97, 127, 85, 86

(56) References Cited

U.S. PATENT DOCUMENTS 3,019,851 A * 2/1962 Doss ..... 182/111
3,033,309 A * 5/1962 Fugere ..... 182/90
3,869,742 A * 3/1975 Gale et al. ..... 114/362
4,355,701 A * 10/1982 Nicholson ..... 182/97
4,432,436 A * 2/1984 Suiter ..... 182/97
5,113,782 A * 5/1992 McCarty ..... 114/362
5,163,531 A * 11/1992 Whiting ..... 182/89
5,287,945 A * 2/1994 Thurlow ..... 182/97
6,237,523 B1 * 5/2001 Day et al. ..... 114/362

OTHER PUBLICATIONS

Garelick Mfg. Co. Catalog, 2003, p. 6, Items 19833, 19812, 19803.

* cited by examiner

*Primary Examiner*—S. Joseph Morano
*Assistant Examiner*—Lars A. Olson
(74) *Attorney, Agent, or Firm*—Jacobson and Johnson

(57) ABSTRACT

A ladder which is particularly useful as a boat ladder is constructed with a pair of centrally located side-by-side elongated support members which are movable lengthwise, to a limited degree, with respect to one another. The ladder rungs are pivotally attached to the support members such that when one support member is moved lengthwise the rungs are swung to extend outward from the support members for use as a stepping ladder and swung inward to be in line with the support members to make the ladder compact for storage. The ladder is pivotably engageable with a storage compartment in a boat hull for swinging the ladder downward for use from an opening in the compartment and upward in line with the opening for insertion into the compartment for storage.

17 Claims, 5 Drawing Sheets

COMPACTABLE BOAT LADDER

This application claims the filing date of Provisional Application Serial No. 60/390.545 filed Jun. 24, 2002.

FIELD OF THE INVENTION:

This invention is in the field of ladders which hang down from a supporting structure. More specifically, the invention is directed to a boat ladder which can be compacted for convenient storage when not in use. In one embodiment the ladder is stored in a storage compartment in the boat hull.

DESCRIPTION OF THE PRIOR ART

Conventionally ladders which hang down from a supporting structure, such as boat ladders, have parallel outer elongated rigid support members with longitudinally spaced rungs or steps attached between the support members. For use, a ladder of this type is coupled to a support structure with some type of hook arrangement. When not in use the ladder has to be stored. Usually and often, in the case of a boat ladder, it is laid on the deck or alongside the deck rail or perhaps placed in a small closet after the ladder has been raised out of the water. Copending application by Garelick, et al. Serial No. 10/367,157 filed Feb. 19, 2003 titled COMPACTABLE LADDER FOR A BOAT describes a boat ladder which has an elongated rigid support member in the shape of an I-beam with pivotally attached rungs which can be swung out from the support member for use to provide steps or swing-inward for storage into the I-beam channel. In the storage condition the ladder can be stored in a storage compartment formed in a boat hull.

SUMMARY OF THE INVENTION

A pair of elongated rigid support members, rest side by side, each support member having an interior space to accommodate longitudinally spaced ladder rungs. Each rung is pivotally attached to both support members and the support members are lengthwise movable with respect to one another over a short distance. When one of the support members is moved lengthwise in a first direction to a first or storage position the rungs are pivotally swung into the support member interior spaces so that they are in line with the support members to form a compact package for convenient storage. When the one support member is moved lengthwise with respect to the other in the reverse direction to a second or use position, the rungs are pivotally swung to extend outward at right angles from the support members to be used in their conventional fashion as ladder steps. In the second or use position the support members may be coupled to or may engage a releasable lock mechanism which prevents the support members from moving longitudinally with respect to one another to ensure that the ladder stays in the use position. If desired, the ladder may also be releasably locked in the storage position.

In a particular embodiment when not in use the ladder is stored in a tubular compartment formed in a boat hull below the deck of the boat. For use, the compacted ladder is slid out of the compartment through an access opening and extends downward from the compartment into the water.

DESCRIPTION OF THE PREFERRED EMBODIMENTS

Figure 1:
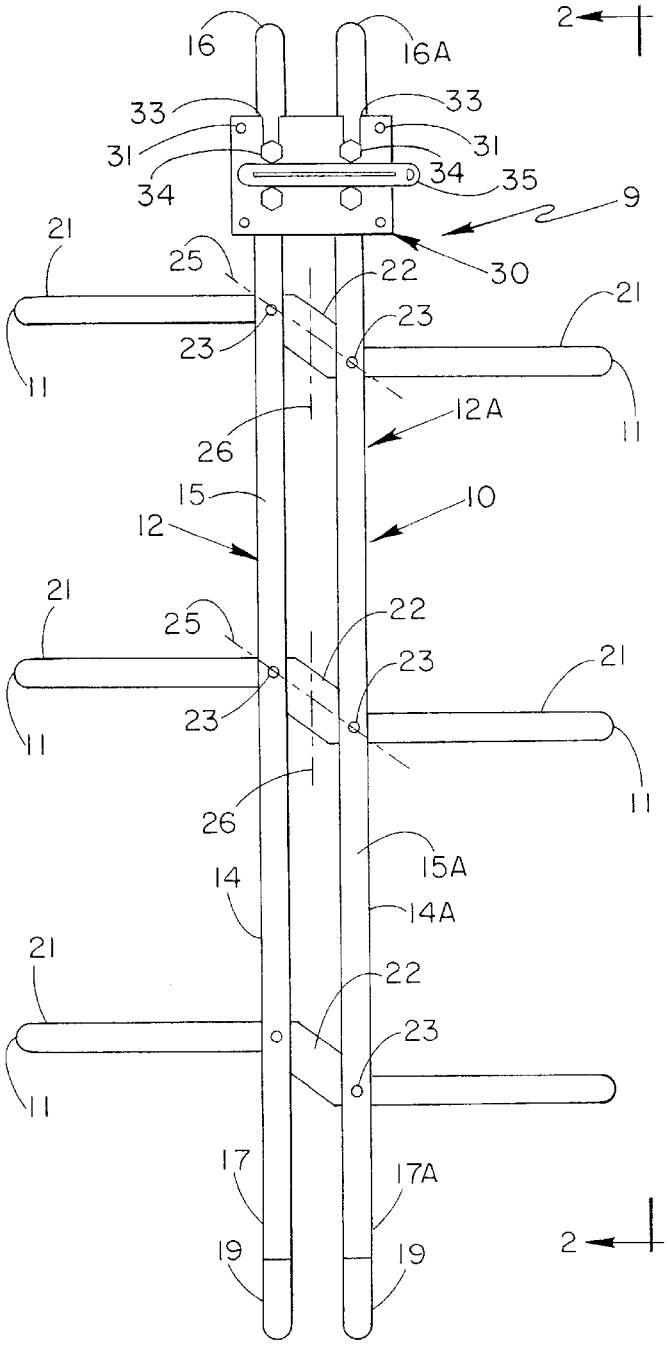
FIG. 1 is a back view of an embodiment of the invention mounted onto a supporting structure for use.
Figure 3:
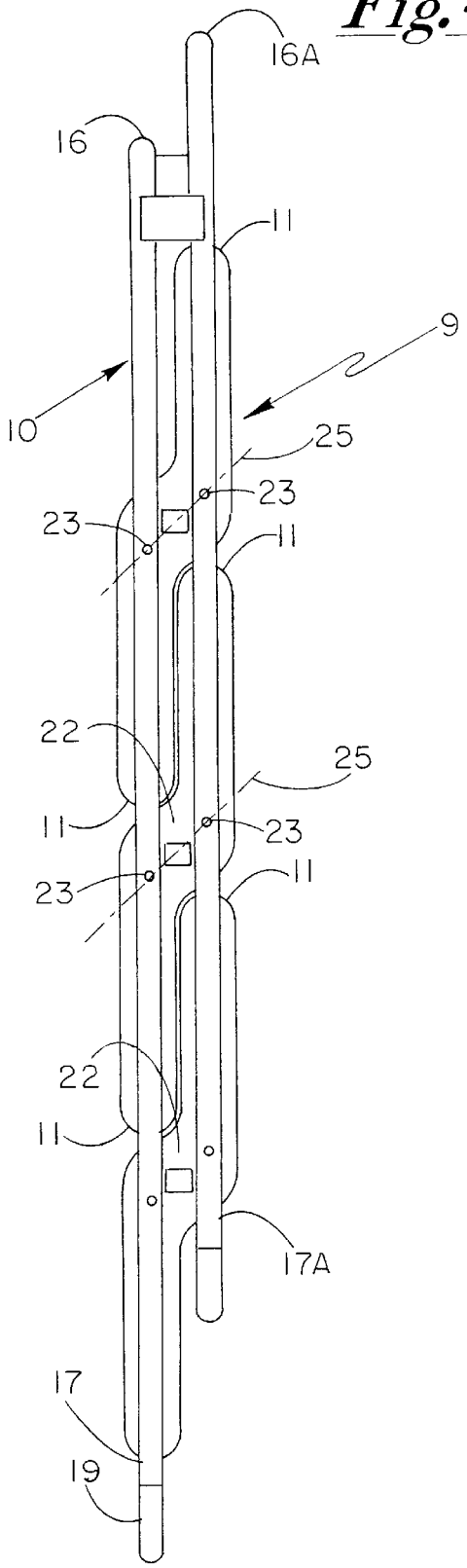
FIG. 3 is a front view of the same embodiment compacted or folded for storage.

Unlike conventional ladders in which the steps or rungs are supported at each end by a pair of outer rigid support members, the ladder 9 of the present invention has a center or midsite elongated rigid support assembly 10 and when in use the ladder rungs or steps 11 extend outward laterally from the center support assembly 10. Support assembly 10 is made up of a pair of elongated rigid side-by-side support members 12 and 12A which, as will be described later, are slidably movable lengthwise, to a limited degree, with respect to one another. Each support member 12 and 12A has, for reference purposes, respectively, a front leg 14 and 14A, a parallel spaced back leg 15 and 15A, a top or upper end 16 and 16A and a bottom end 17 and 17A. Both support members 12 and 12A have spaces 20 between or framed by their respective front and back legs. Each rung 11 is engaged with corresponding support members 12 and 12A and is located in spaces 20. Rungs 11 have left and right stepping areas 21 for climbing up or down the ladder when in the use position, such as illustrated in FIG. 1, and have an intermediate section 22 located in spaces 20. At the intermediate sections 22 each rung 11 is pivotally connected by a set of pivot pins 23 to its respective front leg 14 and corresponding back leg 15 and to front leg 14A and corresponding back leg 15A of support members 12 and 12A. The rung pivot connections couple the two support members 12 and 12A together yet allow them to be moved, to a limited degree, lengthwise with respect to one another. With support members 12 and 12A resting close to one another, almost side-by-side, when one support member is moved lengthwise rungs 11 pivotally swing inward in line with the support members for storage or outward from the support members for use as a ladder. In the use position, i.e., for climbing, as illustrated in FIG. 1, a line 25 shown in dashed form drawn between the center of the pivot pins 23 for each rung attachment forms a forty-five degree angle with respect to a plane generally parallel to the plane defined by each support member 12 and 12A illustrated by dashed line 26. In the storage or non-use position for placing the ladder in storage, as illustrated in FIG. 3, dashed line 25 forms a forty-five degree angle with respect to the same plane mentioned above. In the use position as illustrated in FIG. 1 the rungs are extended outward at about a right angle to the vertical support members 12 and 12A to provide the stepping or climbing areas 21 for going up and down the ladder. As viewed in FIG. 1, the step areas on opposite sides of the support member for each of the rungs are displaced or offset vertically with respect to one another. This is a feature which allows successive rungs to occupy space 20 opposite one another in their respective support members. Absent the offset, each step of each rung would be restricted in length to one-half the distance between successive rungs. Alternatively, the rung steps could be made of uniform thickness about equal to the width of the two support members 12 and 12A but with a front or back half of each step cut out so the rungs can rest side by side within space 20 when in the storage position. Although preferably the rungs are generally rectangular in shape, alternative shapes, e.g., cylindrical, may be used.

Figure 4:
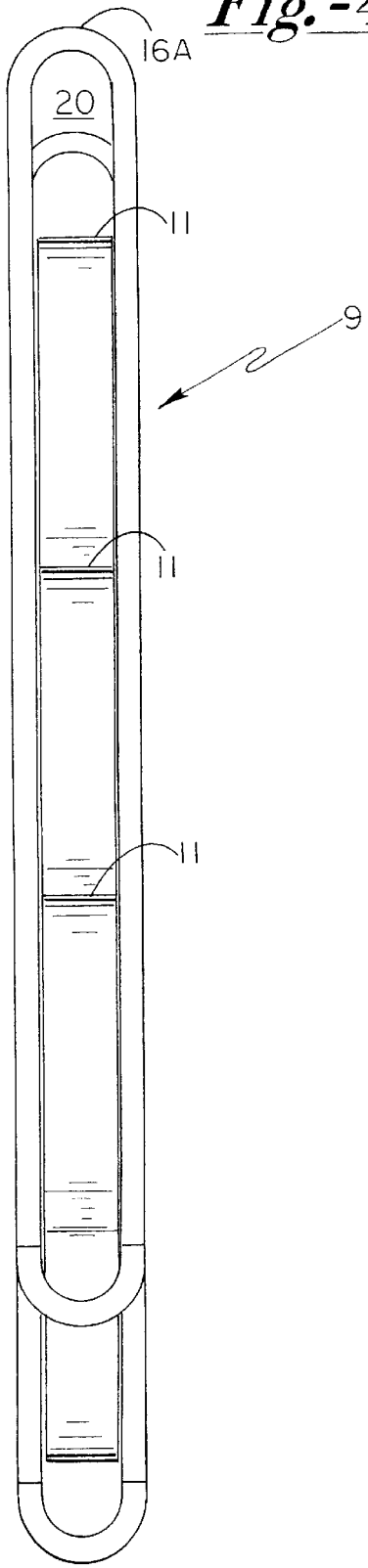
FIG. 4 is a side view of FIG. 3.
Figure 5:
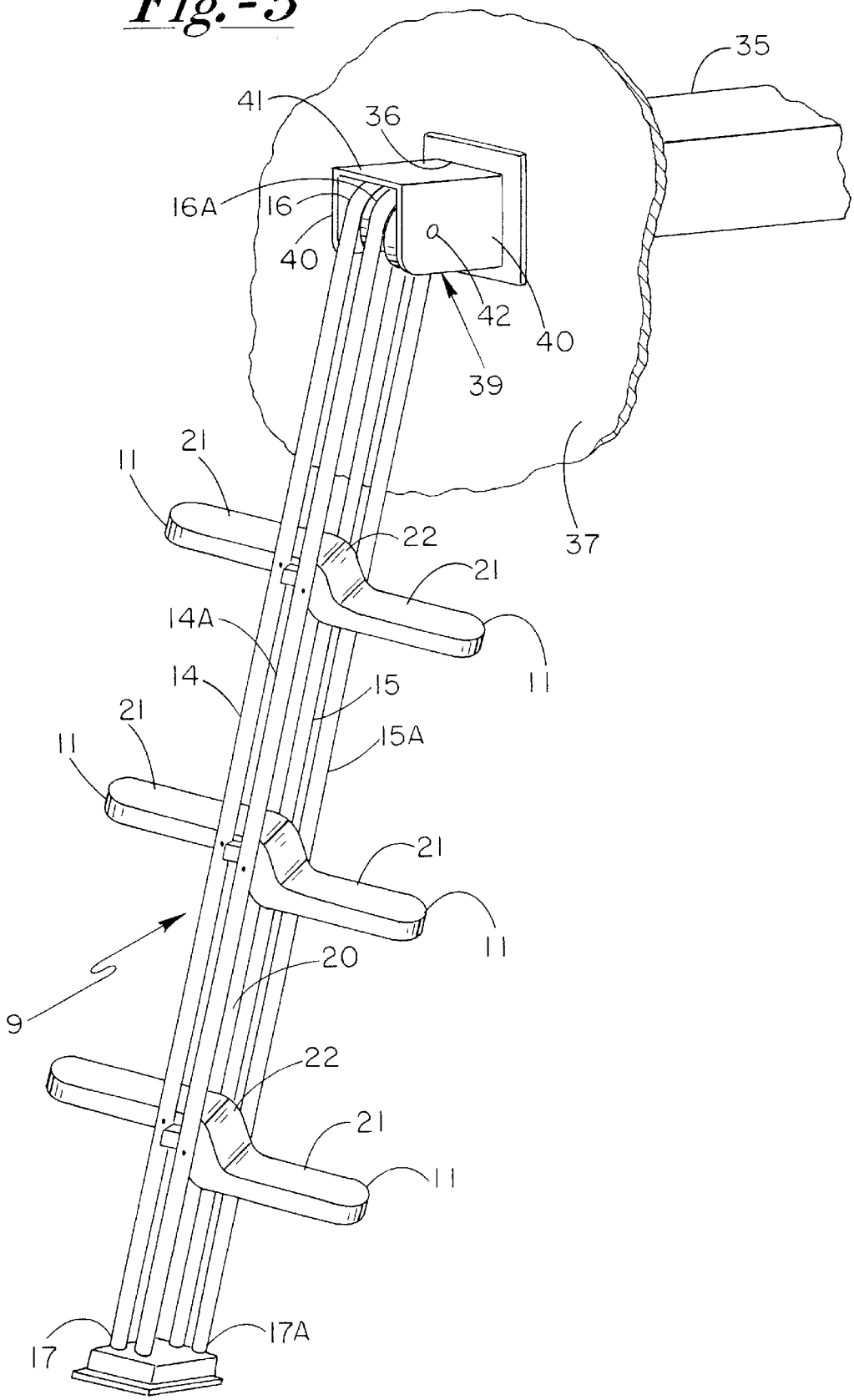
FIG. 5 is an illustration of an embodiment hanging downward for use from a storage compartment.
Figure 6:
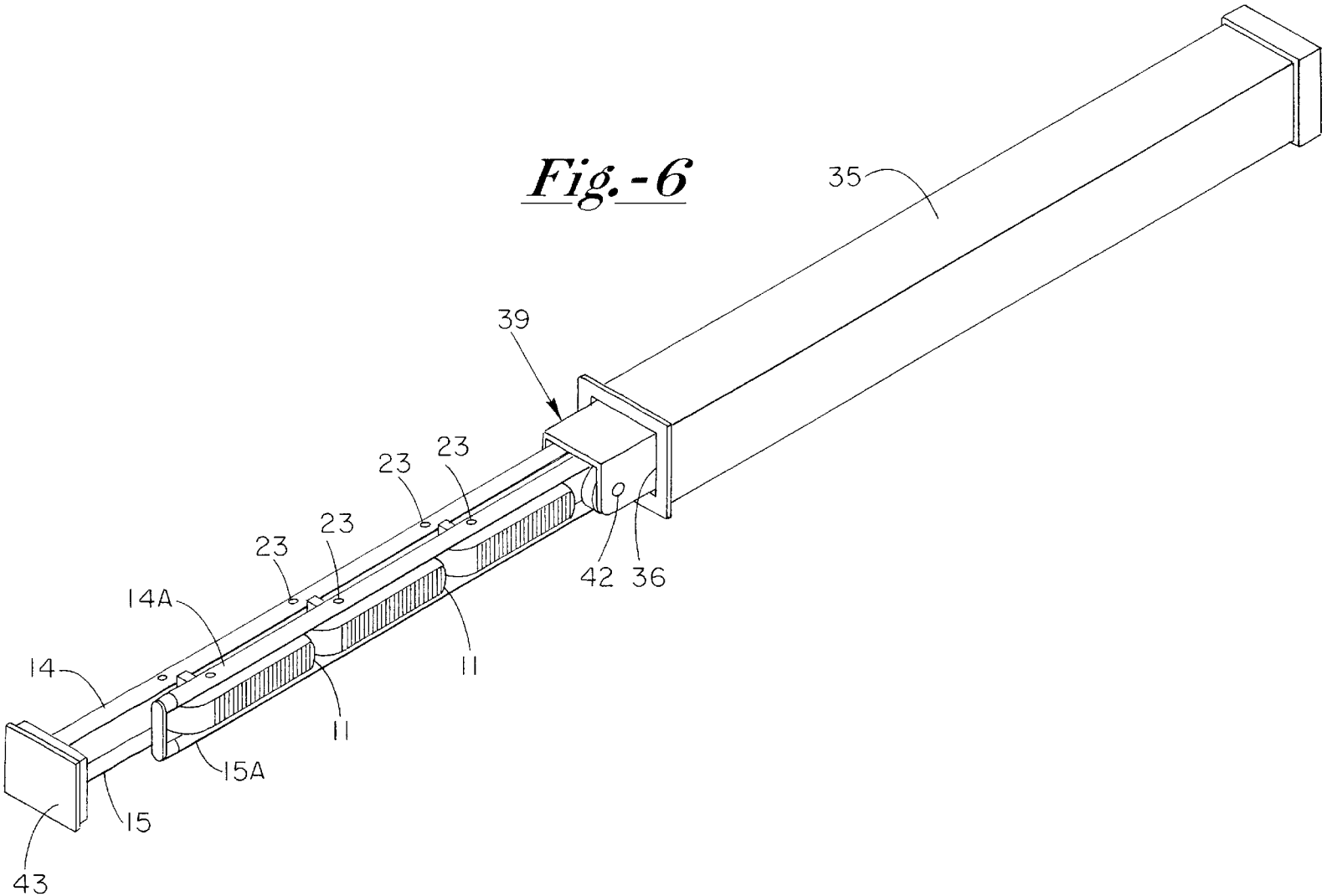
FIG. 6 is an illustration of an embodiment compacted for storage in a storage compartment.
Figure 7:
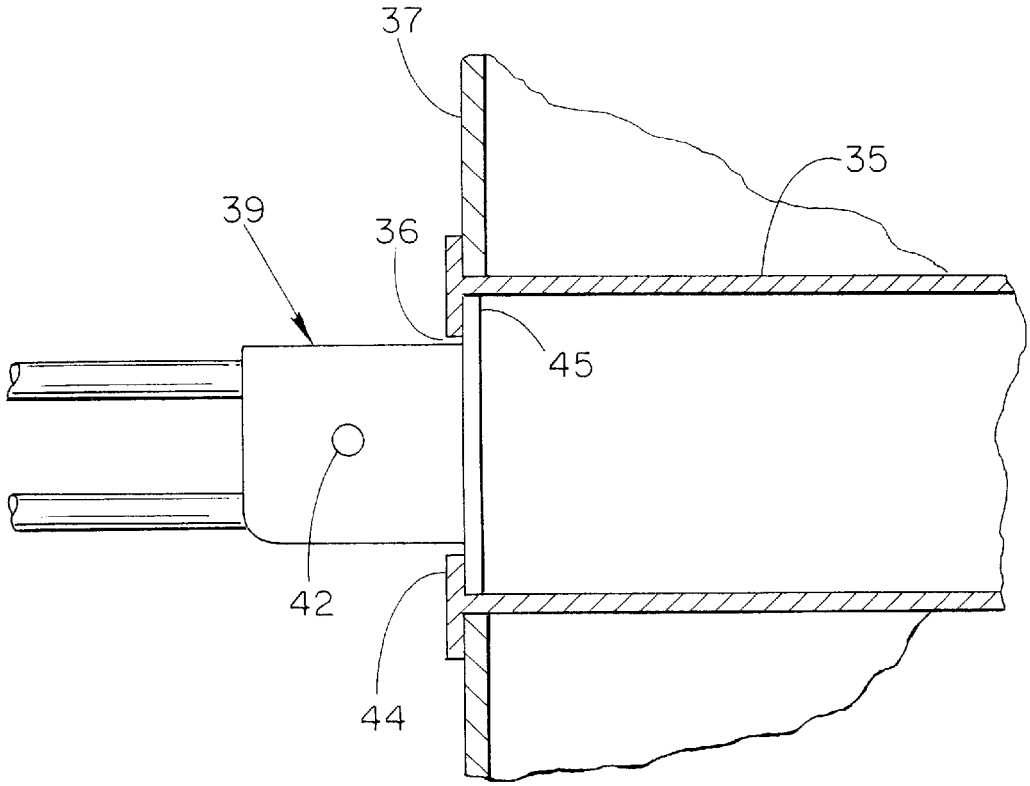
FIG. 7 is a partial section illustrating a stop in a storage compartment.

If the ladder is in the use position, when one of the support members 12 or l2A is moved vertically or lengthwise with respect to the other the rungs 11 swing inward about their pivot points 23 into the spaces 20 so the ladder is then in the storage or nonuse position as shown in FIGS. 3 and 4. In practice, when one of the support members 12 or 12A is moved vertically with respect to the other, in the course of travel the support members separate laterally a short distance.

Preferably support members 12 and 12A are made out of metal tubing which is bent to form the back and front legs with the curved closed section being the top sections 16 and 16A and open at the bottom ends 17 and 17A. As mentioned earlier the space 20 between each of the front and back legs is occupied by the rungs 11 when in the storage position. Typically, with no limitation thereto intended, members 12 and 12A may be made of ⅞" dia., 16 gauge no. 304 or 316 stainless steel tubing and rungs 11 about 3" thick with three rungs spaced about 10" apart.

Figure 2:
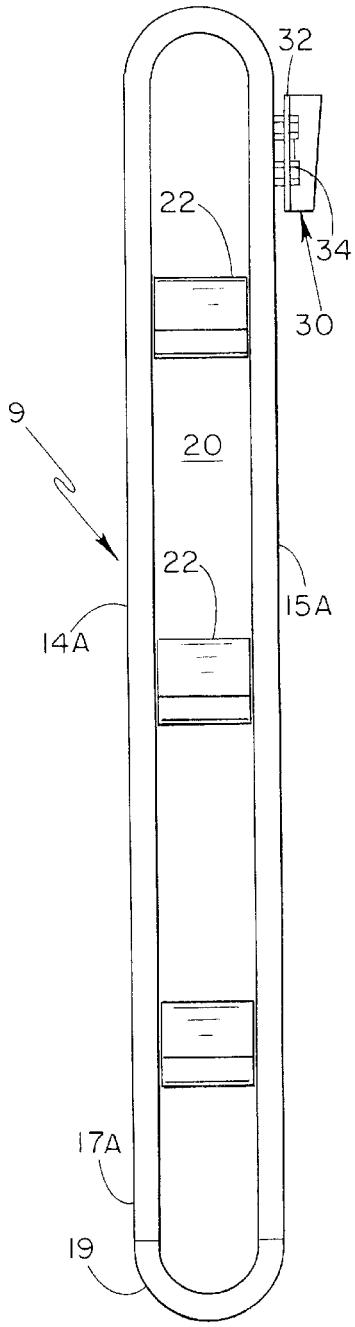
FIG. 2 a side view of the FIG. 1 illustration.

In one mode of use, the ladder may be attached to a supporting structure such as the exterior of a boat hull or a dock. Typically a bracket 30 may be attached in a conventional fashion to a dock or side of a boat, not shown, by bolts or screws 31. A plate 32 extending out as part of bracket 31 has a pair of parallel vertical slots 33 for engaging two sets of capped studs 34 which are attached to and extend rearward from the back legs 15 and 15A. With the studs 34 inserted in the slots 3e3 the ladder is ready for use by the user to climb up and down. A bar or shim 35 may be inserted in place to secure the ladder against accidentally being folded when engaged with the bracket 30. FIGS. 1 and 2 are shown as an example of a ladder constructed according to the teachings of the invention that can be removably attached to a supporting structure for use. As illustrated in FIGS.1–4, the bottom end s 17 and 17A of members 12 and 12A may be covered with tubular members or caps 19 for appearance and as a safety precaution.

The ladder of the instant invention can be attached to a boat to be able to move lengthwise into a tubular chamber for storage and out of the chamber for use. Typically, for example, an elongated hollow tubular storage compartment or chamber 35 can be formed in a boat hull below the deck of the boat with an open end 36 at the exterior side 37 (port or starboard) or rear (aft) of the boat. A slide block 39 is slidably engaged in the interior of storage compartment 35. Slide block has a pair of side members 40 and a top member 41 defining a channel with a pivot pin 42 extending between the side members 40. The closed top ends 16 and 16A of supports 12 and 12A are looped over pivot pin 42. For storage, ladder 9 is swung about pivot pin 42 so it is in line with the storage space of compartment 35 and then inserted into the storage chamber with slide block 39. A cover 43 attached to end 17 of members 14 and 15 can be used to close off opening 36. For use, the ladder is pulled from compartment 35 and allowed to swing downward and one support member moved lengthwise to swing the rungs out for use, as explained earlier. A stop flange 43 on slide block 39 striking a lip 44 at the opening of compartment 35 prevents the ladder from disengaging from compartment 35.

We claim:

1. A compactable ladder comprising:

a pair of rigid elongated ladder support members arranged side-by-side lengthwise, said support members movable lengthwise with respect to one another between a use position and a storage position;

a set of ladder rungs pivotally attached at lengthwise-spaced intervals to both of said support members, said rungs pivotally swung outward to provide ladder steps when one of said support members is moved lengthwise with respect to the other support member to a use position and pivotally swung inward generally parallel to said support members for storage when said one support member is moved with respect to the other support member to a storage position.

2. A ladder as described in claim 1 further including releasable locking means coupled to said support members for releasably holding said support members in the use position.

3. A ladder as described in claim 1 wherein each rung is attached by a separate pivot pin to each of said support members such that a straight line drawn from the axial center of the pivot pin on one support member to the axial center of the pivot pin on the other support member forms about a forty-five degree angle with the lengthwise plane of the support members in the use and in the storage positions.

4. A compactable storable boat ladder comprising:

a pair of elongated rigid support members in side-by-side close proximity with said members lengthwise movable with respect to one another, each support member having space for ladder rungs;

lengthwise-spaced ladder rungs each pivotally attached to both support members in said spaces, said rungs pivotally swingable between a first position generally parallel to the support members wholly contained in said spaces for storage and a second position outward from the support members for use when one support member is correspondingly moved lengthwise with respect to the other support member from a first position for storage to a second position for use.

5. A compactable storable boat ladder as described in claim 4 further including releasable locking means for releasably holding said support members in said second position.

6. A compactable storable boat ladder as described in claim 5 wherein each rung is attached by a pivot pin to each support member, a line drawn from the axial center of one pivot pin to the axial center of the other pivot pin on each rung forms about a forty-five degree angle with a longitudinal line of the support members at said first and second positions of said support members.

7. A compactable storable boat ladder comprising:

a pair of elongated rigid support members in side-by-side close proximity movable lengthwise with respect to one another, each support member having parallel, spaced-apart, elongated rigid front and back members;

longitudinally-spaced rigid rungs located in the spaces between the front and back members of said support members, each rung pivotally attached to the front and back members of both support members;

said rungs swung to a position generally parallel to the length of said support members substantially contained within said spaces when one of said support members is moved lengthwise with respect to the other to a first position for storage and said rungs swung outward generally perpendicular to said support members when said one support member is moved with respect to the other to a second position for use;

an elongated hollow tubular ladder storage compartment in a boat hull, said compartment having an access opening at one end at the boat hull exterior;

a slide block slidably engaged in said storage compartment;

stop means for preventing said slide block from disengaging from said storage compartment at the open end of said compartment;

means pivotally coupling an end of said support members to said slide block, said support members pivotally swingable downward from said slide block when said slide block is at the open end of said storage compartment.

8. A storable boat ladder, comprising:

a generally horizontal elongated tubular storage compartment for a boat ladder in the hull of a boat, the compartment having an access opening at the hull exterior;

a boat ladder hanging down from said access opening for use and resting in said compartment when stored, said ladder comprising a pair of elongated rigid support members, each support member comprising a pair of parallel, spaced-apart, elongated rigid front and back members, said support members in side-by-side close proximity with the spaces between the front and back members facing one another and rigid rungs located in the spaces between the front and back members, each rung pivotally attached to the front and back members of both support members, said rungs swung to a first position generally parallel to said support members generally wholly contained within said spaces when said support members are moved lengthwise with respect to one another to a first position for storage and said rungs swung to a second position generally perpendicular to said support members when said support members are moved with respect to one another to a second position for use.

9. A storable boat ladder as described in claim 8 wherein said ladder is pivotably engaged with said storage compartment at said access opening whereby the ladder is pivotably swingable downward from said storage compartment to said second position for use and upward from said second position to said first position for insertion into said compartment for storage.

10. A storable boat ladder as described in claim 9 further including a releasable lock mechanism holding said support members in said second position.

11. A storable boat ladder as described in claim 10 wherein said mechanism comprises:

a rigid inverted U shaped channel member having two sides and a top slidably engaged in said compartment;

a stop located proximate said access opening for preventing said channel member from exiting the compartment;

a pivot pin attached to the sides of said channel member extending across said channel member;

pivot openings in said support members engaging said pivot pin between the sides of said channel member such that said support members are swingable for insertion into said compartment for storage and are swingable downward outside said compartment for use.

12. A storable boat ladder as described in claim 11 wherein the pivot opening in one of said support members is slotted lengthwise such that said one support member is lengthwise movable with respect to the other support member between said first and second positions.

13. A storable boat ladder as described in claim 12 wherein the top of said channel member prevents said one support member from moving lengthwise when in said second position.

14. A compactable, storable boat ladder comprising, in combination:

a) an elongated rigid ladder support;

b) ladder steps longitudinally spaced along said support, said steps pivotally attached to said support to swing generally perpendicularly outward from both sides of said support for use and inward generally parallel to said support for storage;

c) an elongated hollow tubular ladder storage compartment in the hull of a boat below the boat deck, said compartment dimensioned to hold the ladder in the storage condition, said compartment having an access opening at the exterior of the boat; and d) means pivotally coupling an end of said ladder support to said compartment for pivotally swinging said ladder downward from said storage compartment for use and upward for insertion into the compartment for storage.

15. A compactable boat ladder as described in claim 14 wherein said pivotally coupling means comprises:

a) a slide block slidably located in said compartment;

b) a stop for preventing said slide block from exiting said compartment through said access opening; and c) means pivotally coupling said ladder support at about its upper end to said slide block.

16. A compactable, storable boat ladder comprising, in combination:

a) an elongated rigid ladder support;

b) ladder steps longitudinally spaced along said support, said steps pivotally attached to said support to swing generally perpendicularly outward from both sides of said support for use and inward generally parallel to said support for storage;

c) an elongated hollow tubular chamber in the hull of a boat below the boat deck, said chamber dimensioned to hold the ladder in the storage condition, said chamber having an access opening at the exterior of the boat;

d) a slide block slidably located in said chamber;

e) a stop for preventing said slide block from exiting said chamber through said access opening; and f) said ladder support pivotally engaged at one end to said block for pivotally swinging said ladder support downward from said storage chamber for use and upward for insertion into the chamber for storage.

17. A method for storing a boat ladder comprising the steps of:

a) forming a storage compartment in a boat below the boat deck with an access opening at the boat exterior;

b) pivotally coupling a boat ladder having an elongated rigid center support with pivotally attached longitudinally-spaced steps at about its upper end to the storage compartment at about the access opening so that the ladder can be swung downward for use and swung upward from the use position for storage in the storage compartment;

c) pivotally swinging the ladder steps generally outward from the center support when the ladder is swung downward for use;

d) pivotally swinging the ladder steps inward generally parallel to the center support when the ladder is swung upward from the use position and placing the ladder into the storage compartment through the access opening.

* * * * *